US005503584A

United States Patent [19]

Tulling

[11] Patent Number: 5,503,584

[45] Date of Patent: Apr. 2, 1996

[54] PARACHUTE TOY

[75] Inventor: Jack Tulling, Ridgefield, N.J.

[73] Assignee: Dan-Dee International Limited, Jersey City, N.J.

[21] Appl. No.: 357,542

[22] Filed: Dec. 16, 1994

Related U.S. Application Data

[63] Continuation of Ser. No. 57,623, May 4, 1993, abandoned.

[51] Int. Cl.[6] ..... A63H 33/20; A63H 3/02

[52] U.S. Cl. ..... 446/49; 446/369

[58] Field of Search ..... 446/49–55, 72, 446/73, 74, 369, 372, 391, 324, 362, 363

[56] References Cited

U.S. PATENT DOCUMENTS

| | | | |
|---|---|---|---|
| 757,247 | 4/1904 | Altermatt | 446/51 |
| 930,452 | 8/1909 | Zook . | |
| 1,108,596 | 8/1914 | Manson-Olin | 446/49 |
| 1,533,428 | 4/1925 | Kittleson | 446/74 X |
| 1,558,814 | 10/1925 | Kastead . | |
| 1,709,627 | 4/1929 | Osborne . | |
| 1,845,613 | 2/1932 | Marx | 446/50 |
| 1,894,333 | 1/1933 | Williams . | |
| 2,042,270 | 5/1936 | Moore et al. . | |
| 2,199,163 | 4/1940 | Quady . | |
| 2,219,311 | 10/1940 | Hammond et al. . | |
| 2,262,395 | 11/1941 | Hammond . | |
| 2,277,882 | 3/1942 | Quady . | |
| 2,321,904 | 6/1943 | Frazier . | |
| 2,363,970 | 11/1944 | Kalep | 446/54 |
| 2,468,997 | 5/1949 | Osgood | 446/362 |
| 2,587,699 | 3/1952 | Coller | 446/54 |
| 2,630,654 | 3/1953 | Poen . | |
| 3,205,613 | 9/1965 | Hammond . | |
| 3,257,752 | 6/1966 | Gordon III . | |
| 3,736,603 | 6/1973 | Rothman | 446/72 X |
| 3,822,502 | 6/1974 | Belz | 446/52 |
| 3,996,694 | 12/1976 | Zinser | 446/228 |
| 4,008,541 | 2/1977 | Russer . | |
| 4,889,512 | 12/1989 | Burnett et al. | 446/72 |
| 5,046,985 | 9/1991 | Cearfoss | 446/372 X |

FOREIGN PATENT DOCUMENTS

| | | | |
|---|---|---|---|
| 0058625 | 8/1982 | European Pat. Off. | 446/49 |
| 2110098 | 6/1983 | United Kingdom | 446/369 |

*Primary Examiner*—Robert A. Hafer
*Assistant Examiner*—D. Neal Muir
*Attorney, Agent, or Firm*—Amster, Rothstein & Ebenstein

[57] ABSTRACT

A parachuting stuffed toy defined by a body having a head disposed at the top end thereof, a pair of legs extending outwardly from the bottom end thereof, a pair of arms extending outwardly below said head, and having an external skin wrapped around an elastic filler material suitable for maintaining a defined outer peripheral surface after being squeezed or deformed, the figure having a pouch associated with the back side thereof for storing a parachute attached to the figure by a plurality of shroud lines.

2 Claims, 1 Drawing Sheet

PARACHUTE TOY

This is a continuation of application Ser. No. 08/057,623 filed on May 4, 1993 now abandoned.

BACKGROUND OF THE INVENTION

This invention relates generally to parachuting toys, and more particularly, to a stuffed toy figure having an attached parachute storable in a pouch on the rear side of the figure.

DESCRIPTION OF THE PRIOR ART

Parachuting toys are well known in the art. Many types have been provided, some having relatively detailed and complex mechanisms to effectuate parachute release at a critical point during flight. However, in spite of the extensive array of inventions directed to such parachuting toys, none of these teach a stuffed toy figure having an attached parachute which may be stored in a pouch integral with the figure.

SUMMARY OF THE INVENTION

In accordance with the present invention, there is provided a plush-type parachuting toy figure which may represent any one of a variety of caricatures, generally comprised of a body having a head disposed at the top end thereof, a pair of arms having integral hands extending outwardly below the head, and a pair of legs having integral feet extending outwardly at the bottom end thereof. The figure may be fabricated as a single, integral unit of squeezable elastic material such as foam, or in constituent parts joined together in a final assembly. The foam may be covered by a thin woven skin or the like, preferably constructed from a plurality of panels, joined together along a plurality of stitch lines. A pouch is defined by attaching a single piece of skin material to the rear of the figure to create a storage volume for housing the parachute when not in use.

The parachute skin is fabricated from a plurality of panels of woven material or the like. They are joined along a plurality of stitch lines and attached to the figure by a plurality of shroud lines. The shroud lines are optimally disposed on the body to ensure stability during the descent. As an added means of stability, an aperture is centrally defined in the chute so that air may freely pass therethrough. Some of the shroud lines may be attached to a pair of flaps or ears which are integral with the figure such that they flap into an extended position during flight. To use the toy, the child removes the parachute from the pouch, folds it twice over upon itself, and throws the figure skyward, causing the chute to unfurl and return the figure gently to earth.

In accordance with the present invention, it is an object thereof to provide a parachuting plush toy having an integral pouch for storing the parachute when not in use.

It is a further object of the invention to provide a parachuting plush toy which may be configured as a squeezable caricature.

In accordance with these and other objects which will become apparent hereinafter, the instant invention will now be described with particular reference to the accompanying drawing.

DETAILED DESCRIPTION OF THE PREFERRED EMBODIMENT

Figure 1:
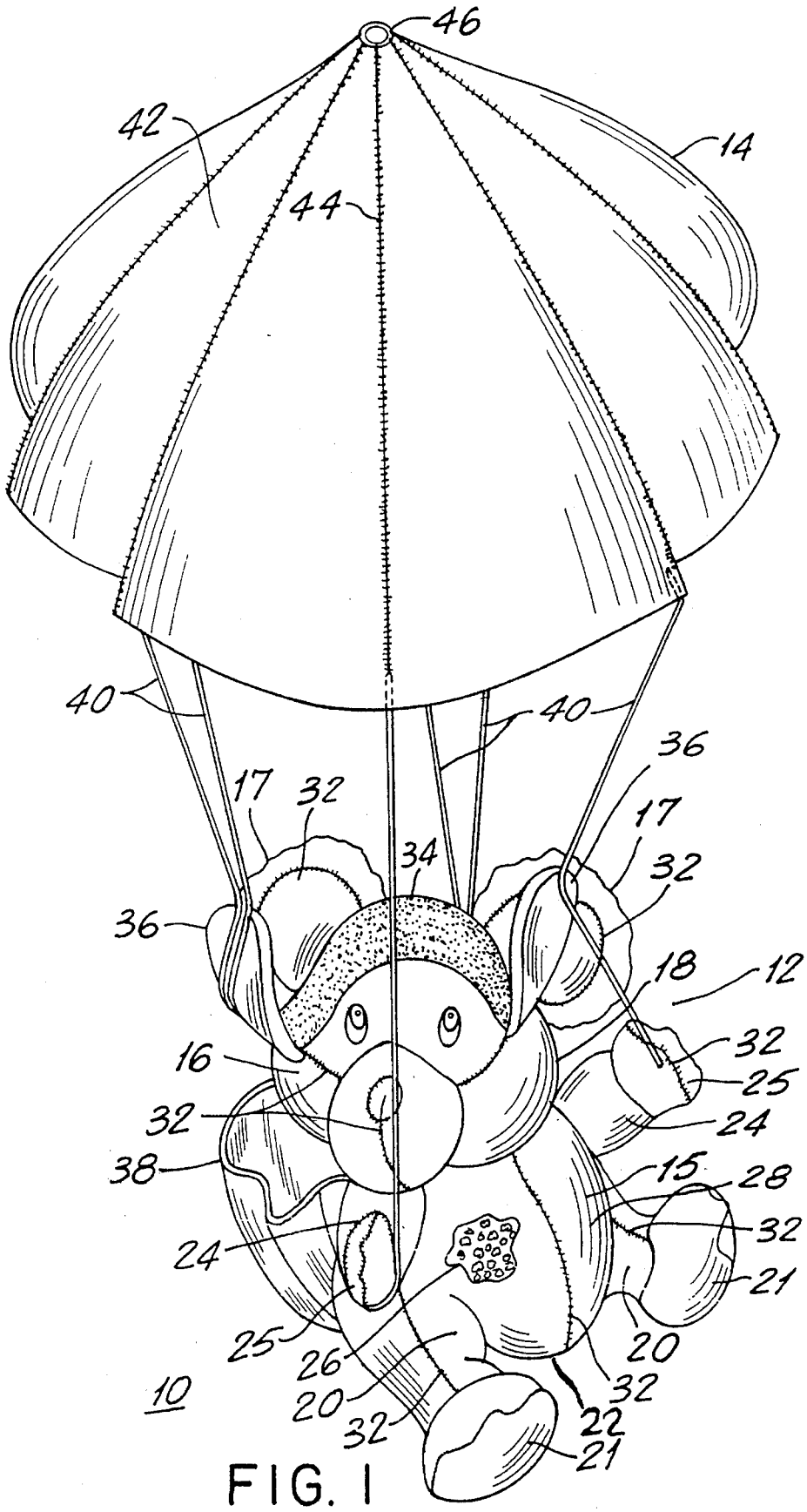
FIG. 1 is a perspective view of the parachuting toy from the front, top and one side.

With reference to the drawing, there is depicted a parachuting toy characterized by the reference numeral 10. Toy 10 is generally comprised of a FIG. 12 and parachute 14.

FIG. 12 may be configured in any one of a variety of caricatures typically known to children including, but not limited to, bears, pigs, dogs, cats, bunnies, monkeys, reptiles, etc. In certain configurations such as dogs, cats or the like, FIG. 12 may have legs in lieu of arms, and in others, may not have any arms or legs. The character embodied in the drawing and detailed description is merely exemplary. FIG. 12 is typically comprised of a body 15 having a head 16 disposed at the top end 18 thereof, a pair of legs 20 having integral feet 21 extending outwardly from the bottom end 22 thereof, and a pair of arms 24 having integral hands 25 extending outwardly beneath head 16. The exact location of legs 20 and arms 24 may vary, depending upon the type of character embodied. Additionally, head 16 may include a pair of ears 17. FIG. 12 may be fabricated as a single, integral unit of squeezable elastic material such as foam 26, or in separate components joined together in a final assembly. An outer skin 28 disposed on the exterior of FIG. 12 may be provided, attached thereto by wrapping a plurality of contiguous individual panels 30 of a woven material, and joining them together along stitch lines 32. FIG. 12 may include a velour pile 34 disposed across the top of head 16 in the shape of a cap or helmet. Pile 34 has a pair of elongated flaps 36 which extend downwardly when FIG. 12 is at rest, but which may flap into an extended position during flight as will be described in detail hereinbelow. A pouch 38 fabricated similarly to skin 28, is disposed on the rear of, and attached to body 14. Pouch 38 is sized to accommodate parachute 14 therein for storage.

Parachute 14 is attached to FIG. 12 by a plurality of shroud lines 40. Shroud lines 40 are attached to parachute 14 at adjacent locations, where contiguous skin panels 42 are joined along stitch lines 44. Shroud lines 40 are similarly attached to FIG. 14 at suitable locations depending upon the configuration thereof. A preferable orientation is to affix shroud lines 40 to areas proximal to the head 16/body 15 interface, hands 25 and flaps 36. In this manner, flaps 36 will move upwards when parachute 14 supports the weight of FIG. 12 during descent. Shroud lines 40 may be attached to a pair of drooping ears 17 in lieu of flaps 36, to provide a visual effect of the ears flapping upwards into an extended position during flight. Panels 42 may be fabricated from woven materials similar to body skin 28 or the like, and different colors may be used for enhanced aesthetic appeal. Parachute 14 may be constructed in a variety of shapes within the scope of the invention. To improve stability during the descent, an aperture 46 is defined in the middle of parachute 14 to allow air to pass therethrough.

To operate parachute toy 10, the user removes parachute 14 from pouch 36, folds it neatly two times over upon itself, and throws toy 10 skyward. As it travels, parachute 14 will unfurl and slow the descent of toy 10 back to earth.

The present invention has been shown and described in what is considered to be the most practical and preferred embodiment. It is anticipated, however, that departures may be made therefrom, and obvious modifications will be implemented by a person skilled in the art.

I claim:

1. A parachuting toy, comprising:

a squeezable plush toy figure having a body, a head disposed at a top end of said body, a pair of legs extending outwardly from a bottom end of said body, and a pair of arms extending outwardly from said body below said head, said head comprising a simulated headpiece which includes a plurality of flaps foldable between a first position extending downwardly with respect to said head, and a second position extending upwardly from said body;

a pouch attached to said figure at a back side of said figure, said pouch forming a storage cavity having an open top end; and a foldable parachute attached to said figure by a plurality of shroud lines at a plurality of locations on said figure, at least one of said shroud lines being attached to at least one of said flaps of said figure, said parachute being packable into said pouch and deployable when said toy is hurled upward by a user to gently return said figure to the ground as said at least one said flap is extended upwardly by said shroud line.

2. The parachuting toy recited in claim 1 wherein at least one of said shroud lines is attached to one of said flaps and one of said arms of said figure.

* * * * *